US006244933B1

(12) United States Patent
Morkvenas

(10) Patent No.: US 6,244,933 B1
(45) Date of Patent: Jun. 12, 2001

(54) RANDOM ORBITAL FINISHING APPARATUS

(76) Inventor: Wolfgang Morkvenas, 230 Fleming La., Schaumburg, IL (US) 60193

( * ) Notice: Subject to any disclaimer, the term of this patent is extended or adjusted under 35 U.S.C. 154(b) by 0 days.

(21) Appl. No.: 09/349,037

(22) Filed: Jul. 7, 1999

(51) Int. Cl.[7] ..... B24B 49/00
(52) U.S. Cl. ..... 451/10; 451/270
(58) Field of Search ..... 451/5, 10, 11, 451/259, 260, 270–271, 57, 65, 66, 41, 211, 135

(56) References Cited

U.S. PATENT DOCUMENTS

| | | | | |
|---|---|---|---|---|
| 1,069,803 | * | 8/1913 | Nelson et al. | 451/271 |
| 1,510,976 | * | 10/1924 | Carrie | 451/271 |
| 3,178,860 | | 4/1965 | Clyne . | |
| 3,863,394 | * | 2/1975 | Dumentat | 51/109 R |
| 4,396,836 | * | 8/1983 | Vitaliani et al. | 250/223 R |
| 4,640,056 | * | 2/1987 | Stump | 51/138 |
| 4,760,671 | * | 8/1988 | Ward | 51/215 AR |
| 4,763,515 | * | 8/1988 | Pielach et al. | 73/146 |
| 4,854,085 | | 8/1989 | Huber . | |
| 5,040,340 | | 8/1991 | Bischof . | |
| 5,081,794 | | 1/1992 | Haney . | |
| 5,181,342 | | 1/1993 | Haney . | |
| 5,201,785 | * | 4/1993 | Nagano | 51/358 |
| 5,231,803 | * | 8/1993 | Lanzer | 51/325 |
| 5,274,962 | | 1/1994 | Hundebol . | |
| 5,291,689 | | 3/1994 | Hundebol . | |
| 5,301,471 | * | 4/1994 | Fisher et al. | 51/170 MT |
| 5,321,913 | | 6/1994 | Haney . | |
| 5,441,440 | | 8/1995 | Hundebol . | |
| 5,443,414 | | 8/1995 | Haney . | |
| 5,496,206 | * | 3/1996 | Young | 451/260 |
| 5,558,561 | | 9/1996 | Hundebol . | |
| 5,580,302 | | 12/1996 | Howard Jr. et al. . | |
| 5,582,534 | * | 12/1996 | Shendon et al. | 451/41 |
| 5,601,481 | | 2/1997 | Hundebol . | |
| 5,702,287 | | 12/1997 | Haney . | |
| 5,725,423 | * | 3/1998 | Barry et al . | 451/539 |
| 5,820,448 | * | 10/1998 | Shamouilian et al. | 451/287 |
| 5,829,928 | * | 11/1998 | Harmand et al. | 408/83.5 |
| 5,863,241 | * | 1/1999 | Rottschy | 451/271 |
| 5,899,800 | * | 5/1999 | Shendon | 451/287 |
| 6,009,767 | * | 1/2000 | Rudolph | 74/86 |
| 6,086,461 | * | 7/2000 | Williams et al. | 451/65 |

* cited by examiner

*Primary Examiner*—Derris H. Banks
*Assistant Examiner*—Hadi Shakeri

(57) ABSTRACT

A random orbital finishing apparatus for finishing the surfaces of solid material including wood, plastic, metal and composites, but most particularly plastic solid surface materials. The apparatus includes a conveyor for transporting such unfinished material pass a uniquely mounted random orbital sander where it is subsequently finished thereby. The random orbitals may be dually mounted and in an offset position. The apparatus may further include a system of proximity sensors and air cylinders which enable the random orbitals to automatically adjust their position onto the surface to be finished when the material is passed thereby and subsequently return back to a starting position after the material passes.

16 Claims, 9 Drawing Sheets

RANDOM ORBITAL FINISHING APPARATUS

BACKGROUND OF THE INVENTION

The present invention relates generally to surface finishing, and more particularly to an apparatus which utilizes random orbitals to finish the surfaces of solid material including wood, plastic, and metal.

In many manufacturing processes, it is necessary to sand, grind, and/or polish wood, metal and synthetic material to create a finished surface ready for installation. Such materials may be used to ultimately create products such as shelves, cabinets, furniture, counter-tops and the like. One of the more difficult materials to finish is what is becoming commonly referred to as solid surface materials or as plastic solid surface materials (PSSMs). These are polymer based building materials typically manufactured and sold in sheet form and used to form counter-tops and the like. The most widely recognized of which is the so-called "Corian" material manufactured by DuPont.

Although the present invention may be described as it pertains to the finishing of PSSMs, it will be understood that it is not to be construed as limiting thereto. In fact, it has been found that the present invention finishes metal, wood and other plastic materials with an equally superior effectiveness.

Various machines have been designed to enable the sanding and/or finishing of materials to be done automatically rather than by hand. The early of these such machines typically used a belt sander of some sort. The material would enter the machine, be passed under this belt sander by some means, and exit the machine with what was hoped to be a finished surface. However, the exiting material typically had sand lines where the edges of the belt sander ran along the material and/or rough areas where the belt sander ran opposite the grain when sanding wood materials. To remove these imperfections, additional finishing often had to be done by hand with a hand-held sander or with steel wool.

To alleviate these problems, the next generation of automatic sanders began to orbit the abrasive rather than merely running it back and forth over the material. This, it was hoped, would remove any sanding patterns and eliminate the finish sanding to be done by hand. The most common of such machines includes an elongated abrasive covered platen generally extending the width of the machine. This platen may move in one or two orbits. One created by the rotation of its connecting shafts and the other by the rotation of a brace connecting the shafts. This dual rotation more accurately simulates the motion of sanding by hand.

Although this dual rotating platen may help reduce sand lines and rough areas, it is expensive to manufacture and maintain. Additionally, for this type of sander to function properly, the incoming materials have to be of similar tolerances. Thus, PSSMs are still finished by hand held power sanders known as random orbital sanders.

The basic construction of random orbital sanders typically comprises a motor for driving a balanced shaft for rotational movement about a first or driven axis, and a bearing device for coupling a sanding pad or disc to the balanced shaft for rotational movement relative thereto about a second axis disposed in an offset or parallel relation to the first axis. During operation of this type of sander, the sanding pad is forced to move along a circular path disposed concentrically of or to orbit relative to the first axis, while being free to rotate relative to the second axis.

These random orbital sanders have always been popular in the automotive industry, and, now, they are currently the best way to remove scratches, marks and other imperfections from the relatively hard surfaces of PSSMs. However, these random orbital sanders are hand held sanders and, as such, have certain drawbacks, the most obvious of which is that they are hand held and require a great deal of workmen's time to adequately run the sander over the subject material. Additionally, the manual guidance of these sanders may produce an uneven finish across the material's surface or perhaps a mild bevel effect due to disproportionate sanding.

In view of the aforementioned needs and the shortcomings of the prior art, it is therefore an object of the present invention to provide an apparatus that overcomes the deficiencies of the current practices whereby an apparatus is provided for finishing solid materials with a minimum amount of labor with maximum efficiency at a minimum cost.

It is another object of the present invention to provide an apparatus capable of effectively finishing the relatively hard surfaces of plastic solid surface materials.

Still another object of the present invention is to provide an apparatus for automating sanding work currently performed by hand.

It is yet another object of the present invention to provide an apparatus for providing a finished product having a relatively proportionately even degree of smoothness throughout its surface.

These and other objects, features and advantages of the present invention will be clearly understood through a consideration of the following detailed description.

SUMMARY OF THE INVENTION

According to the present invention, there is provided an apparatus for finishing the surfaces of solid materials having a frame, a conveyor system and a material engaging surface. The conveyor system extends from the front to the back of the frame. A drive means provides a first axis of rotation to a drive shaft which is coupled to at least two orbital shafts. These orbital shafts are coupled to the discs in an offset from center position which provides disc rotation about the orbital shaft and the center of the disc to rotate about the shaft. The material engaging surface covers the discs to finish the surface of the material.

BRIEF DESCRIPTION OF THE DRAWINGS

The features of the present invention which are believed to be novel are set forth with particularity in the appended claims. The invention, together with the further objects and advantages thereof, may best be understood by reference to the following description taken in conjunction with the accompanying drawings, in the several figures of which like reference numerals identify like elements, and in which:

DESCRIPTION OF THE PREFERRED EMBODIMENTS

Figure 1:
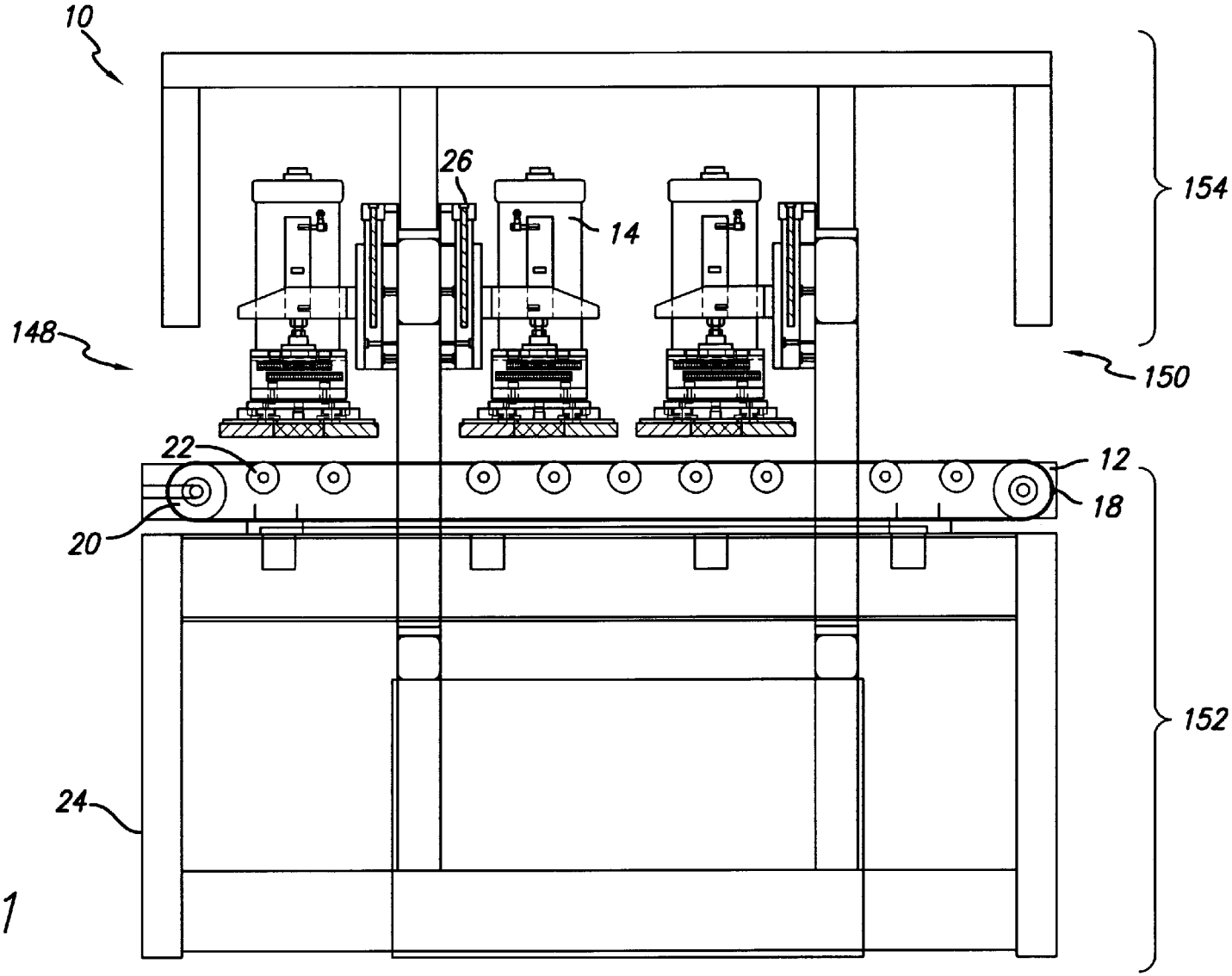
FIG. 1 is a side view shown partially in cross-section of the first embodiment of the Random Orbital Finishing Apparatus of the present invention.
Figure 2:
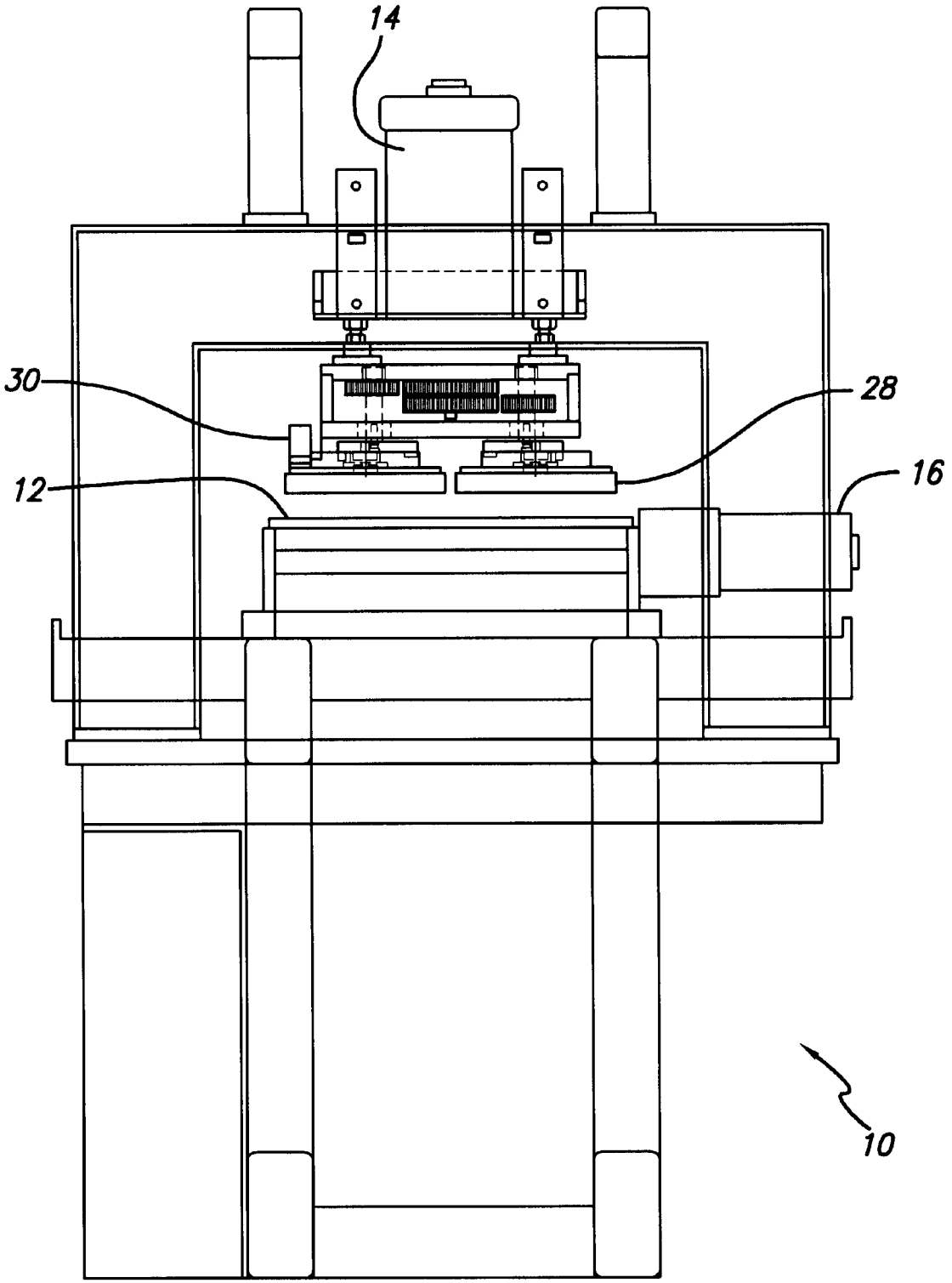
FIG. 2 is a front view shown partially in cross-section of the Random Orbital Finishing Apparatus of FIG. 1.

Referring to the first embodiment, and FIGS. 1–2 in particular, a random orbital finishing apparatus 10, is illustrated in partial cross-section. The apparatus includes a main conveyor belt 12 which transports the PSSM (not shown), or other material to be finished from its front-end 148, under a series of uniquely mounted random orbitals 14 to its back and 150. Conveyor belt 12 is powered by a transport drive motor 16 which drives belt 12 about the rear end roller of the front-end roller 02 drive pulley 18 and tension roller 20. Transport rollers 22 provide the needed added support for the belt 12 to effectively convey the material when the random orbitals 14 are applying force against the surface of the material during the finishing process. The drive motor and all rollers are mounted within the bottom half 152 of the mainframe 24.

The top half 154 of mainframe 24 provides the support for the mounting of the random orbitals 14 thereon. An adjustable slide mount 26 is used so as to enable the random orbital 14 to adjust their height and thus the finishing pads 28 height relative to the conveyor belt 12. During operation, the proximity switch 30 of each random orbital 14 detects when the material is passing thereunder and signals the air cylinder 66 of that particular random orbital to lower the orbital 14 to its predetermined operating height.

Figure 3:
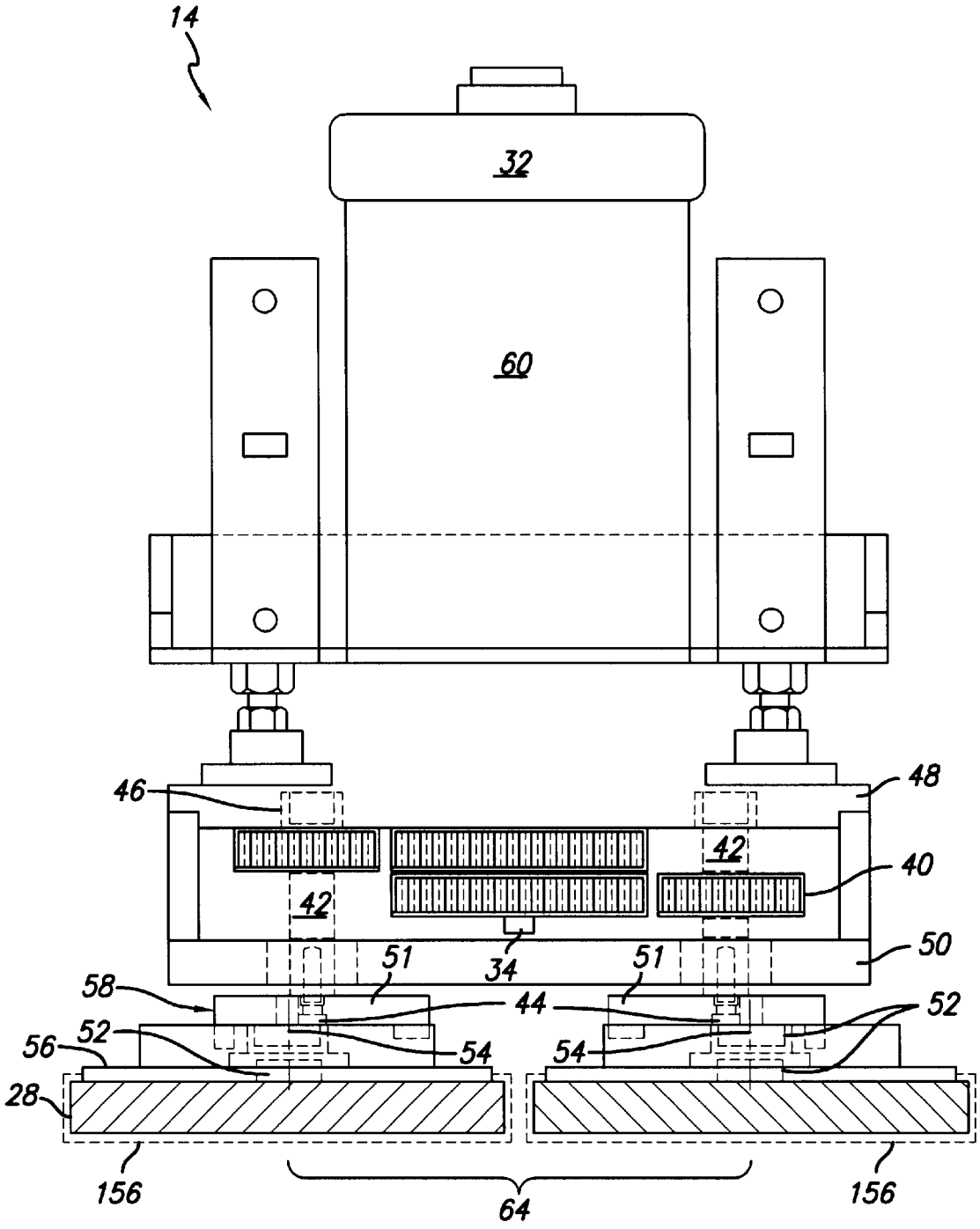
FIG. 3 is an enlarged front view shown partially in cross-section of the dually mounted random orbitals of the Random Orbital Finishing Apparatus of FIG. 1.
Figure 4:
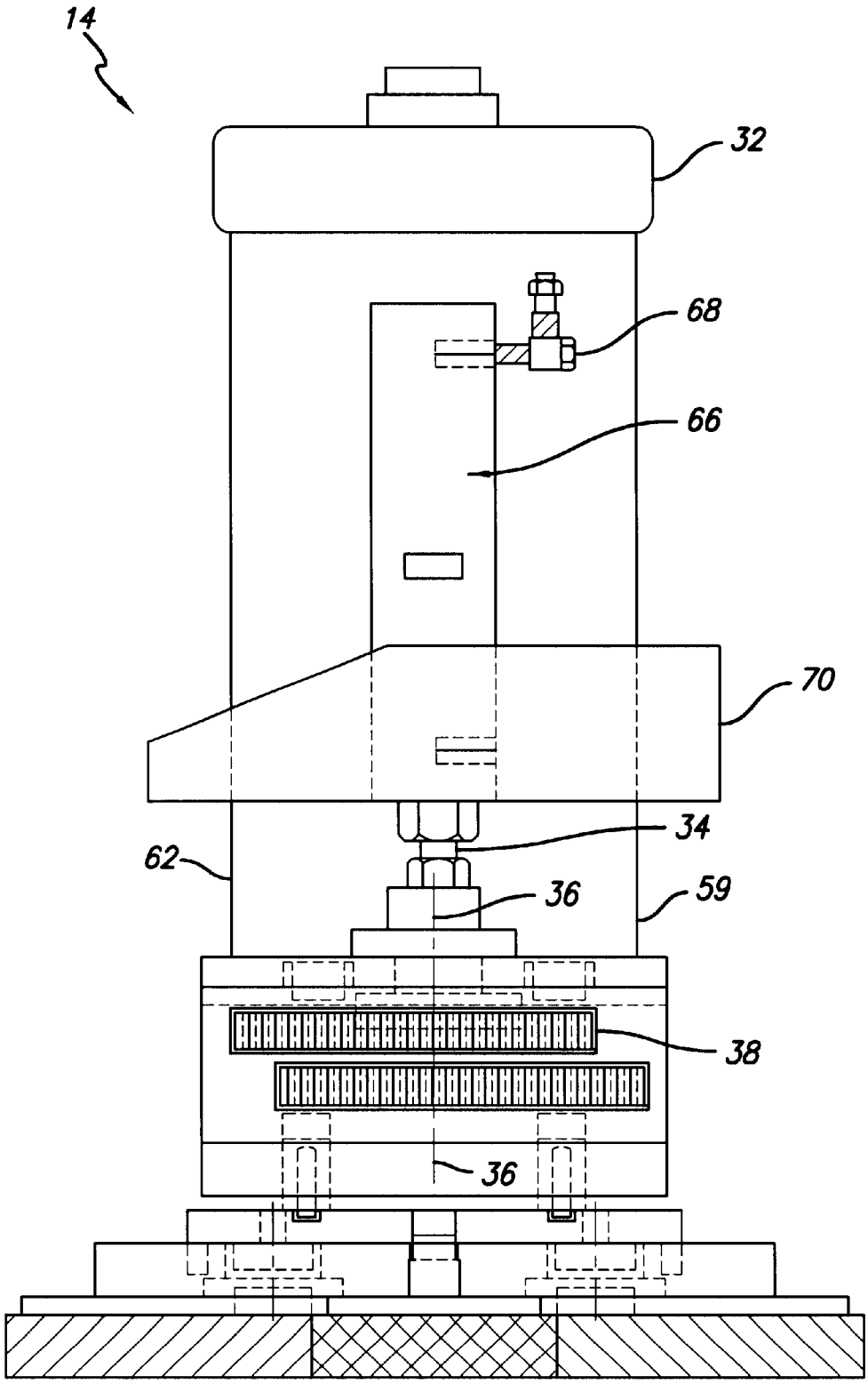
FIG. 4 is an enlarged side view shown partially in cross-section of the random orbitals of FIG. 3.

The random orbitals of the present invention are illustrated in partial cross-section in FIGS. 3 and 4. These Figures clearly illustrate the invention's dual random orbital configuration. In particular, driver motor 32 or other driving means drives shaft 34 about a first rotations axis or drive axis 36. Drive shaft 34 in turn drives gear belts 38 which rotate gear pulleys 40 and thus orbital shafts 42 about a second rotational axis or orbital shaft axis 44. Each orbital shaft 42 is supported at one end by, and includes, a top bearing 46 positioned within the mainplate 48 of random orbital 14 configuration. This bearing 46 provides support for each shaft 42 while enabling rotation thereof.

The other end of orbital shafts 42 are partially supported by the backplate 50 and are coupled to cam 51. Thus cam 51 rotates about shaft axis 44. In the preferred embodiment, cam 51 is then coupled to disc 56 via disc bearings 52 in an offset position. In other words, the center of the disc 56 which provides for a third rotational axis or disc bearing axis 54 do not align with orbital shaft axis 44 but are instead offset and parallel. Thus, as the attached cam 51 is rotating or spinning about orbital shaft axis 44, the bearing axis 54 and thus the disc 56 may also be rotating about the orbital shaft axis 44. More particularly, a counterweight 58 is provided atop the disc 56 and opposite the cam 51 to create the necessary momentum to rotate the disc 56 about the disc bearing axis 54.

To summarize, drive shaft 34 rotates about drive axis 36 to drive gear belts 38 to rotate gear pulleys 40. Gear pulleys 40 then rotate orbital shafts 42 and thus cam 51 about orbital shaft axis 44. Now, if the pressure exerted against the disc 56 is less than the inherent disc bearing 52 threshold, the counterweight 58 creates the necessary momentum to rotate the disc 56 about the bearing axis 54 via disc bearing 52. In other words, the speed of rotation of the disc 56, if at all, about bearing axis 54 depends upon the amount of pressure exerted against the disc 56. Thus, the random orbital motion of the present invention includes the rotation of cam 51 about shaft axis 44 and the random rotation of disc 56 about bearing axis 54.

This random orbital movement of the discs 56 provides for a unique finishing area when the abrasive finishing cover 156 is applied to the pads 28 and the dually mounted orbitals of the preferred embodiment are operating to finish the material. More particularly, the two orbital shafts 42 of each random orbital 14 are not squarely mounted with respect to the direction of the conveyor. In fact, and as shown in FIG. 4, one shaft is mounted near the front portion 59 of the orbital housing 60, while the other shaft is mounted near the rear portion 62.

Additionally, because each disc bearing axis 54 rotates about its respective shaft axis 44, the finishing cover is able to finish a wider area then if it was only rotating about its shaft axis. For example, if the pad 28 has a diameter of 20 cm and the shaft axis 44 and disc bearing axis 54 are offset by 2 cm, then the finishing cover will be able to finish 24 cm of the width of the material passed under it. In the illustrated embodiment, the distance 64 between the shaft axis is such that the finishing width of the respective finishing covers overlap. To continue the above example, if this amount of overlap is 3 cm, then the total finishing width of the dually mounted random orbital 14 will be 42 cm. This overlap diminishes any sanding lines which may otherwise appear on the surface of the material due to a side-by-side arrangement of the finishing covers. It will be understood that the present invention may utilize only a single dually mounted random orbital, adjacent dually mounted random orbitals and/or a series of dually mounted random orbitals.

FIG. 4 also illustrates the basic mechanisms for the control of the operating height of the random orbital. The operating height being that position of the random orbital in which the finishing cover will be able to adequately finish the surface of the material. In the first embodiment, this height is set before the material is placed upon the conveyor by manually adjusting the cylinder stops (not shown). These stops prevent the air cylinder 66 from lowering the finishing covers below the predetermined operating height. However, this operating height may be automatically set without the use of the stops, but rather by sensing the thickness of the material and setting the appropriate maximum extension of the air cylinder.

In any event, when the proximity switch 30 senses the material, the air cylinder 66 (through the flow control 68), adjusts the random orbital to its predetermined operating height to enable the finishing covers to finish the surface of the material. Once the material passes the proximity switch 30, the air cylinder returns the random orbital to its starting position. The air cylinder of each random orbital is mounted to slide bracket 70. This slide bracket is adjustably engaged to slide mount 26 so as to enable the bracket and thus the random orbital to slide and adjust its height.

Figure 5:
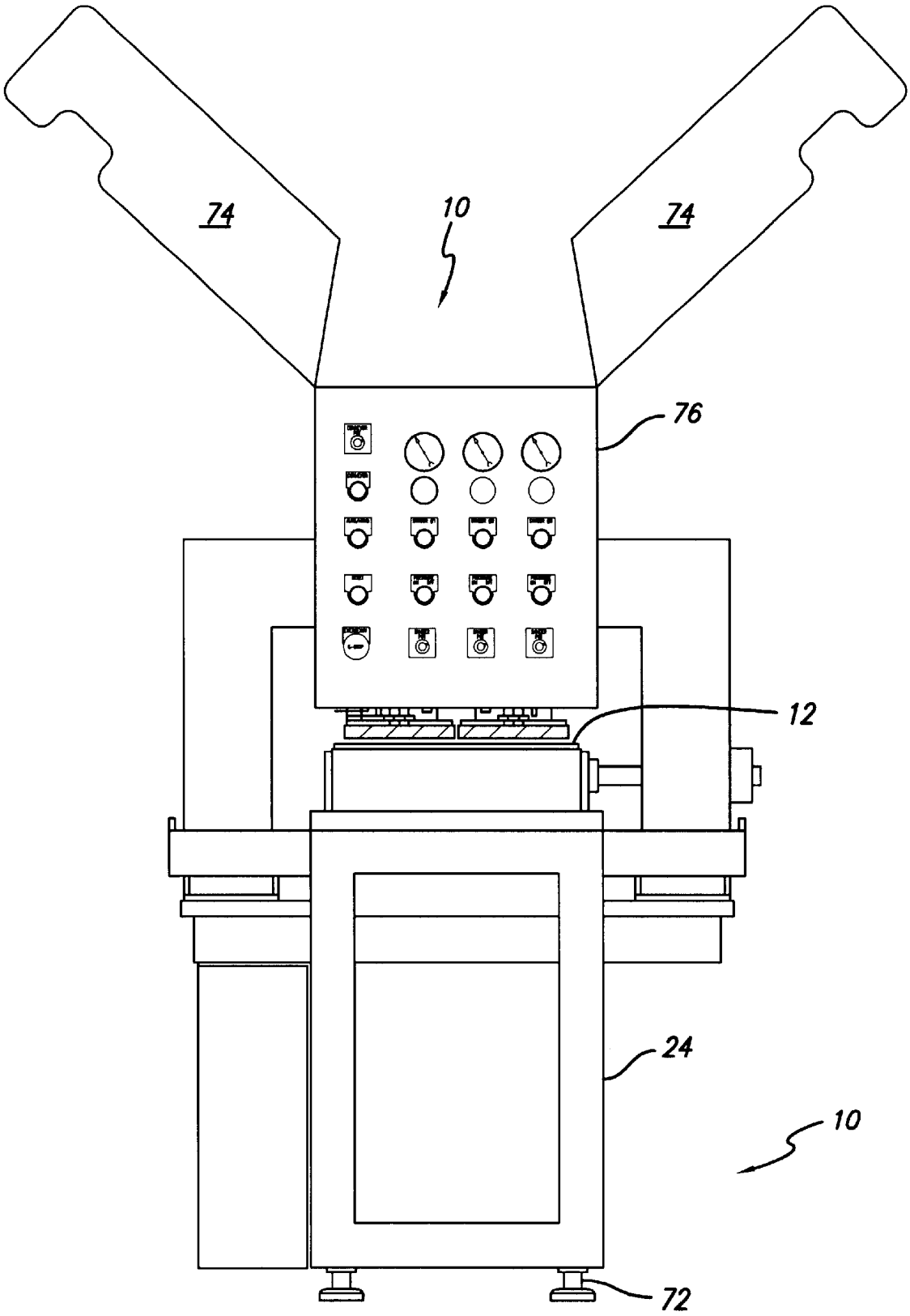
FIG. 5 is a front view of the preferred embodiment of the Random Orbital Finishing Apparatus of the present invention.

FIG. 5 is illustrative of the front view of the preferred embodiment of the random orbital finishing apparatus 10 of the present invention. The mainframe 24 is supported by feet 72 which can be adjusted to level the apparatus. Side covers 74 are provided to protect the user from any debris which may be created when the apparatus is turned on and a piece of unfinished material is placed upon belt 12. The entire operational process is controlled via control panel 76.

Figure 6:
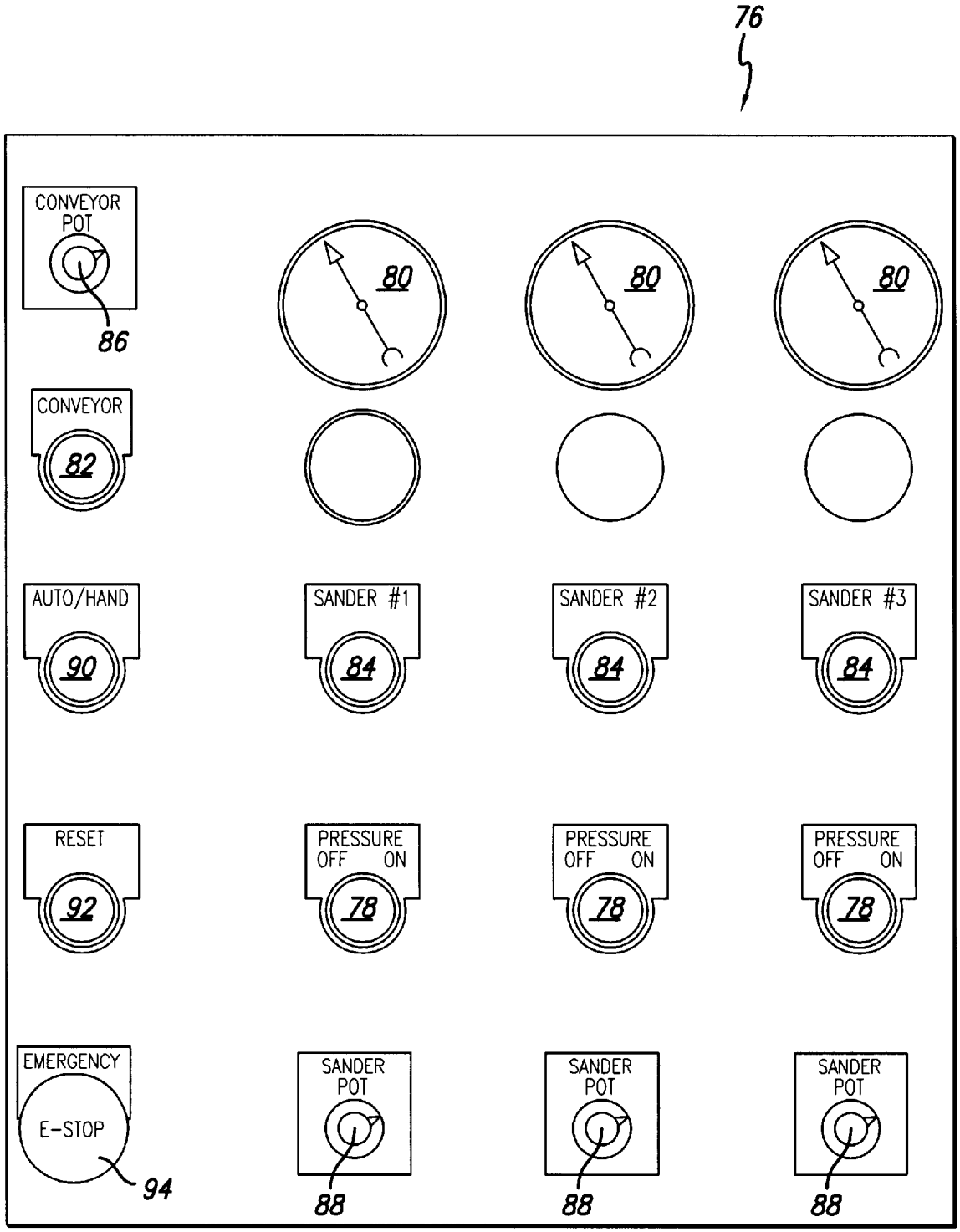
FIG. 6 is an enlarged view of the control panel of FIG. 5.

The control panel 76 of the preferred embodiment is shown in FIG. 6. The pressure supplied to the air cylinders 66 is turned on by the pressure buttons 78 and monitored by pressure gauges 80. The conveyor and orbital power are controlled by buttons 82 and 84 respectively, while their speed is controlled by dials 86 and 88 respectively. The remaining controls on panel 76 of the preferred embodiment include an automatic/hand button 90, a reset button 92 and an emergency stop button 94.

Figure 7:
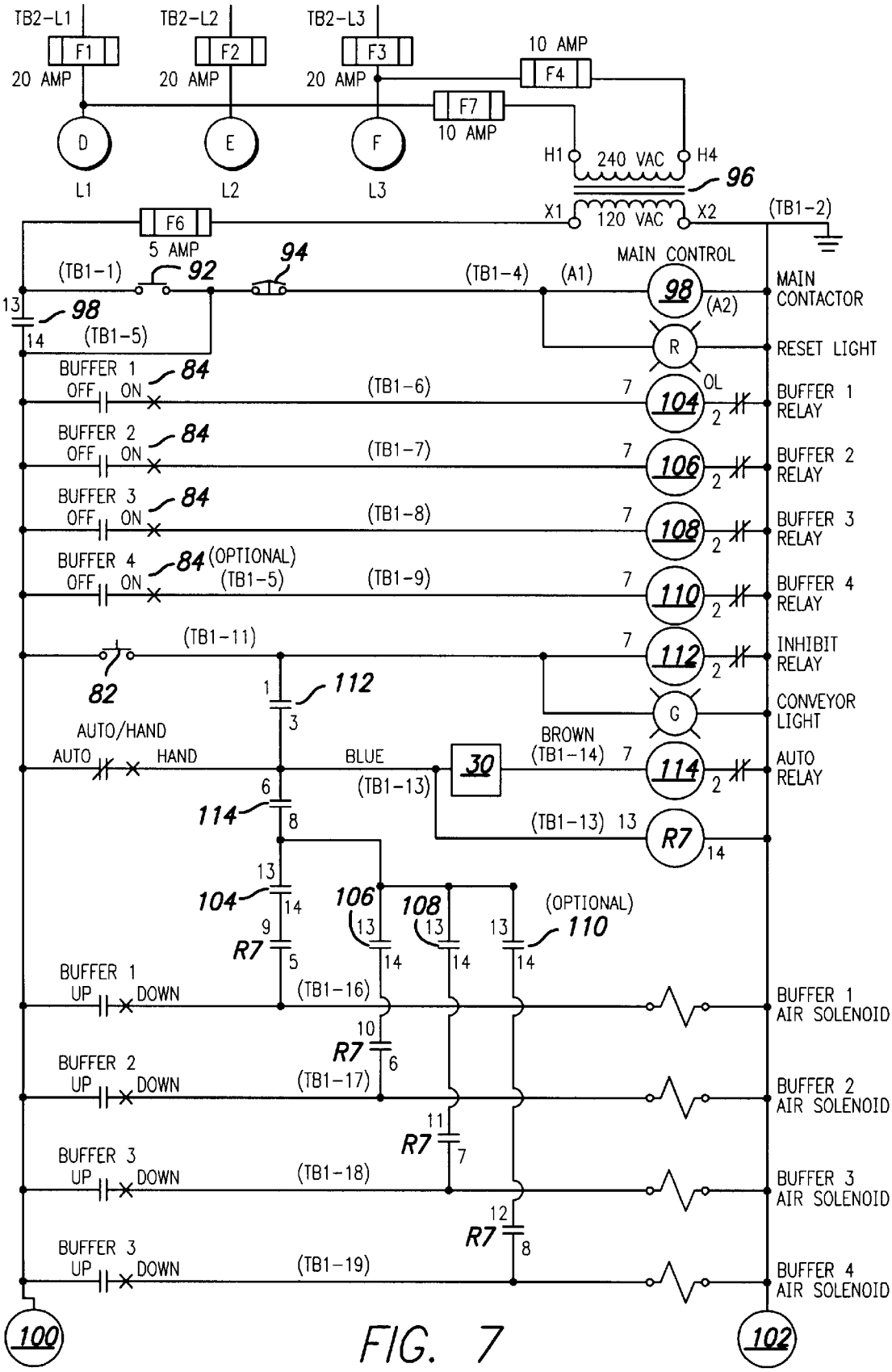
FIG. 7 is a machine schematic diagram of the preferred embodiment of the Random Orbital Finishing Apparatus of the present invention.

The operation and control of the present invention may best be described with respect to and in association with the machine schematic diagram of FIG. 7. Turning thereto, the apparatus is shown to be powered by 120 VAC which is supplied through transformer 96 by which 240 VAC was originally provided. When powered up, the main contactor relay 98 will be closed thereby allowing current to flow through the left side of the schematic 100, and generally from the left side to the right side 102. If the emergency stop button 94 is pressed at any time after power up, the main contactor relay 98 will open and stop the current flow through 100. In that case, the reset button 92 may be depressed to close the main contactor relay and restore current flow.

When the sanders are switched on through buttons 84, relays 104, 106, 108 and 110 will be closed. Note that relay 110 and its associated switch 84 are shown as optional in the Figure. It will be understood that although the embodiment of FIGS. 1–6 illustrated a three sander apparatus, and FIG. 7 illustrates a possible forth, the number of sanders and/or buffers used will depend upon the workload of the machine and other individual design parameters. In any event, if one of the sander buttons 84 is not activated, its associated relay will be held in the open position.

When the conveyor button 82 is activated, inhibit relay 112 will be closed thereby allowing current to flow to the lower half of the circuit, however, if the auto/hand button 90 is activated (i.e. shutting off the conveyor), then inhibit relay 112 will open. In any event, whether transported by conveyor 12 or by hand, when the material to be finished activates the proximity sensor 30, auto relay 114 will close. With auto relay 114 closed and in conjunction with the previously discussed buttons and relays, the appropriate solenoids will be triggered to lower and raise the random orbitals at the appropriate time to finish the surface of the material.

With the foregoing discussion of the internal operation of the apparatus, the typical use thereof will be readily understood. First, if the apparatus is not capable of automatically setting the predetermined operating height, the user must adjust the stops accordingly. The apparatus is then powered up and depending upon how many sanders and/or buffers are to be used, the appropriate buttons 84 are activated. The material may then enter the apparatus via the conveyor belt, if activated (82), or by hand if button 90 is activated. In any event, when the material gets close enough to the random orbitals, the proximity switch 30 senses such and lowers the orbital to finish the surface of the material. The speed of the conveyor and random orbitals may be adjusted to the desired levels via dials 86 and 88 respectively.

Figure 8:
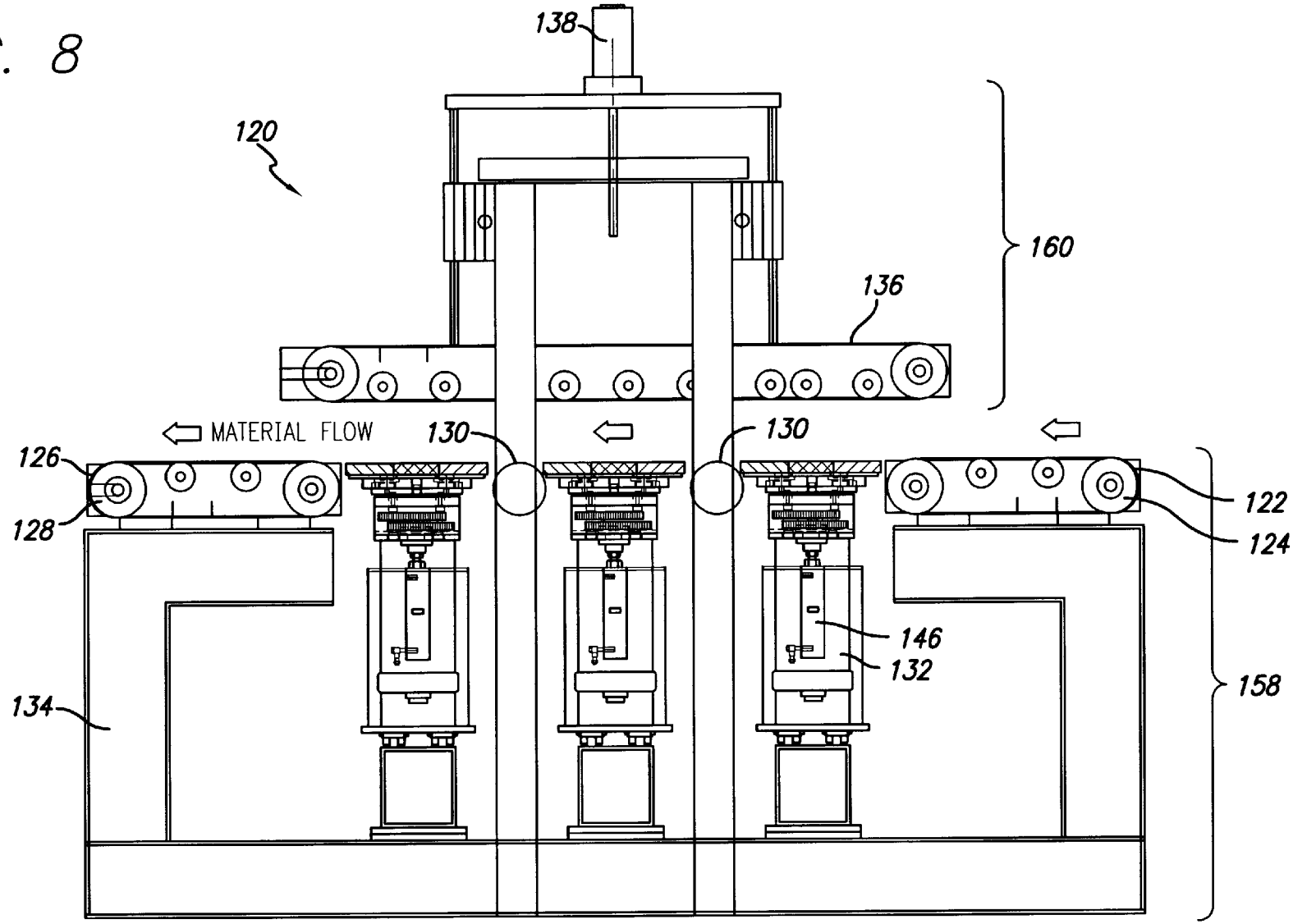
FIG. 8 is a side view shown partially in cross-section of an alternate embodiment of the Random Orbital Finishing Apparatus of the present invention.
Figure 9:
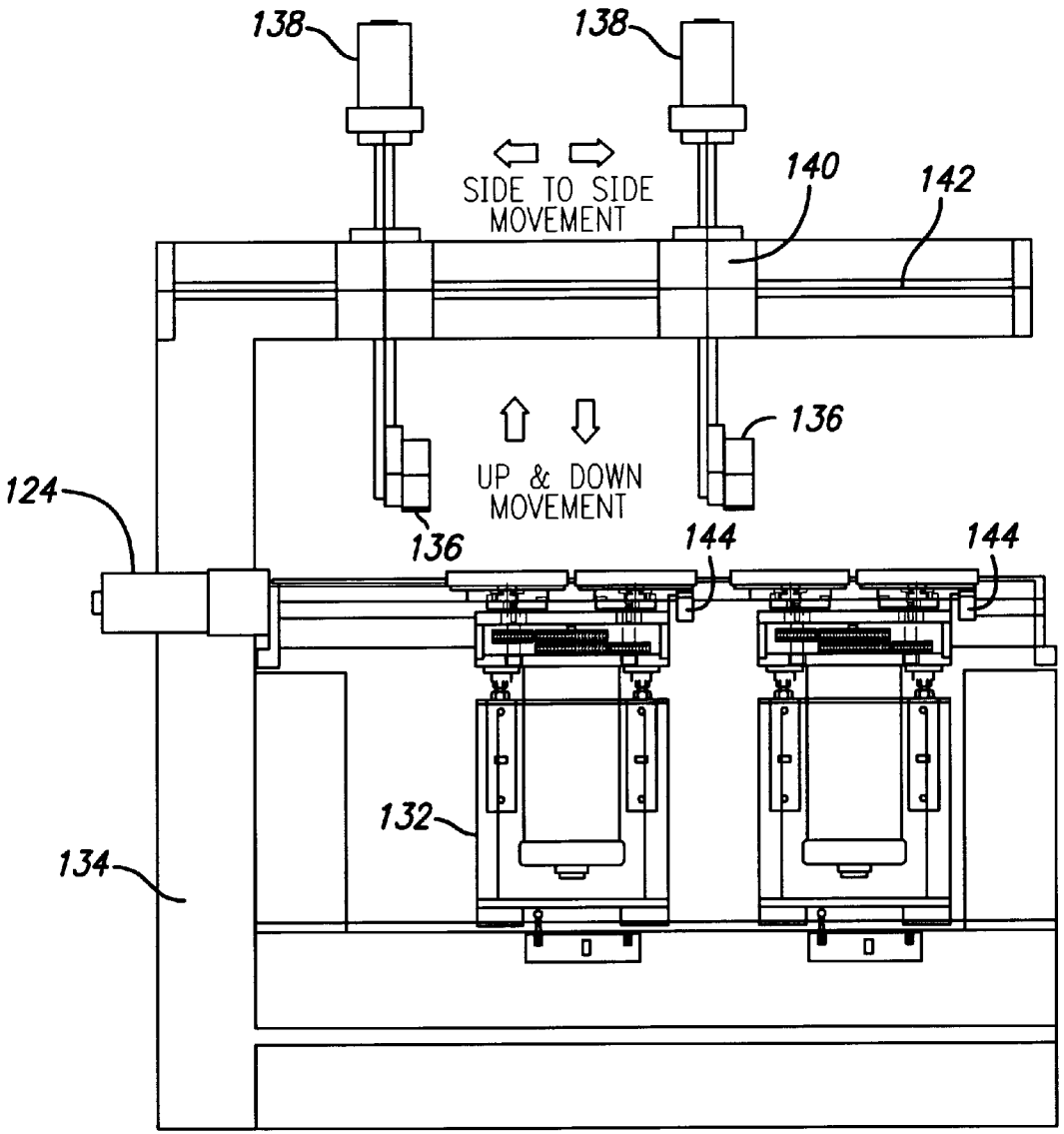
FIG. 9 is a front view shown partially in cross-section of the Random Orbital Finishing Apparatus of FIG. 8.

An alternative embodiment of the present invention is now discussed with respect to FIGS. 8 and 9. Generally, this alternate embodiment differs from that as previously discussed in that the orbitals will be mounted on the lower half of the frame and positioned so that they are below the plane of travel of the material to be finished. In other words, as the first embodiment finished the top surface of the infeed material, this alternate embodiment will finish at the bottom surface of the infeed material.

More particularly, and referring to FIGS. 8 and 9, a random orbital finishing apparatus 120, is illustrated in partial cross-section. This apparatus includes a more sophisticated conveying system than that illustrated in the first embodiment. In particular, this embodiment includes an infeed conveyor belt 122 powered by an infeed drive pulley 124, an outfeed conveyor belt 126 powered by an outfeed drive pulley 128 and intermediate drive support rollers 130 positioned in between the random orbitals 132. These components of the conveying system as well as the random orbitals are mounted within the bottom half 156 of the mainframe 134.

The top half 160 of mainframe 134 provides the support for the mounting of the hold down conveyors 136. These conveyors 136 provide the support against the material when it is acted upon by the random orbitals. As this apparatus 120 is capable of accommodating material of various thicknesses and widths, the hold down conveyors 136 are horizontally and vertically adjustable. Referring to FIG. 9, hold down conveyors 136 are raised and lowered by hold down motor 138. Additionally, hold down conveyors 136 may be adjusted from side to side by either manually or automatically sliding the slide plates 140 through channel 142. With the capacity of these hold down conveyors to be moved up and down as well as sideways, this embodiment need not compensate for the thickness of the material. In other words, the material need not be flat or of a particular thickness, in fact, this embodiment is capable of finishing material of virtually any dimension, for example, a counter-top with a bowl mounted thereon is easily passed through and finished by this apparatus.

FIGS. 8 and 9 illustrate an apparatus with six (6) dually mounted random orbitals 132, which consists of 12 discs. However, it will be understood that any amount of random orbitals 132 may be mounted adjacent each other as well as in series depending upon the particular design parameters. During operation, this embodiment may include proximity switch 144 on each random orbital 132 to detect when the material is passing thereover and signal the air cylinder 146 of that particular random orbital to raise the orbital to its predetermined operating height. Or, this sensing may preferably be controlled by a capacitor switch (not shown) mounted on the infeed table to sense the material and send pulses which will then control the air solenoid to activate the air cylinder 146 to move up and down. Now, glide plates 140 may be positioned and motors 138 may be adjusted to accommodate the particular position needed for each material to be finished.

It will be understood that the random orbital design of the alternate embodiment is the same as the previously discussed embodiment. In particular, the random orbitals of the present invention are of a dually mounted design which may be positioned either above or below the flow of the material to be finished. The positioning as well as the number of random orbitals depending upon the workload and particular design parameters of each apparatus.

While particular embodiments of the invention has been shown and described, it will be obvious to those skilled in the art that changes and modifications may be made therein without departing from the invention in its broader aspects and, therefore, the aim in the appended claims is to cover all such changes and modifications as fall within the true spirit and scope of the invention.

I claim:

1. An apparatus for finishing surfaces of solid materials, comprising:

a frame having a front end and a back end;

a conveyor system extending generally from said front end to said back end;

a drive means supported by said frame, said drive means connected to a drive shaft to provide a first axis of rotation;

at least two orbital shafts coupled to said drive shaft whereby each orbital shaft provides a second axis of rotation;

at least two discs, each of said at least two discs having a center providing a third axis of rotation, each of said at least two discs having a material engaging surface;

each of said at least two orbital shafts being coupled to each of said at least two discs in an offset position form said center such that each of said at least two discs is rotatable about said third axis while said third axis rotates about said second axis;

a cam and counterweight assembly to provide the coupling between the orbital shafts and the discs; and wherein said material engaging surface is capable of being detachably covered by a finishing abrasive whereby when each of said at least two discs is rotating and each of said at least two discs contacts a surface of said solid materials, said finishing abrasive finishes the surface of said solid materials.

2. The apparatus defined in claim 1 further including a transport drive means for driving said conveyor system.

3. The apparatus defined in claim 1 wherein said conveyor system comprises an endless belt wrapped around a front-end roller and a rear-end roller, said conveyor system further including intermediate support rollers.

4. The apparatus defined in claim 1 wherein said conveyor system comprises a top portion and a bottom portion.

5. The apparatus defined in claim 1 wherein said drive means is slidably supported by said frame to enable said discs to vertically adjust their height relative to said conveyor.

6. The apparatus defined in claim 5 further including a sensor for sensing said material, said sensor in communication with a height adjusting means whereby when said material triggers said sensor said adjusting means positions said discs whereby said finishing abrasive finishes the surface of said material.

7. The apparatus defined in claim 6 wherein said adjusting means includes a predetermined operating height.

8. The apparatus defined in claim 1 further including a housing for said drive means wherein one of said orbital shafts is positioned at a first distance from a front end of said housing and another of said orbital shafts is positioned at a second distance from said front end of said housing.

9. A surface finishing apparatus, comprising;

a frame having a front end and a back end;

a housing;

a mount connecting said housing to said frame;

a drive shaft within said housing, said drive shaft powered by a drive means;

said drive shaft coupled to at least two orbital shafts, at least a portion of said at least two orbital shafts extending outside of said housing;

at least two discs, each of said at least two discs having a center and a material engaging surface, each of said at least two discs coupled to each of said at least two orbital shafts, at a position near said center to provide a first disc rotation about the orbital shaft and a second disc rotation about said center; and a cam and counterweight assembly to provide the coupling between the orbital shafts and the discs.

10. The apparatus defined in claim 9 further including a conveyor system for transporting material past said discs.

11. The apparatus defined in claim 10 wherein said conveyor system being an endless belt.

12. The apparatus defined in claim 10 wherein said conveyor system comprises a top and bottom portion.

13. The apparatus defined in claim 9 wherein said housing being slideably supported by said mount to enable said disc to vertically adjust its height.

14. The apparatus defined in claim 13 further including a sensor for sensing material, said sensor in communication with a height adjustment means whereby when said material triggers said sensor said adjustment means positions said discs to finish the surface of said material.

15. The apparatus defined in claim 14 wherein said adjusting means includes a predetermined operating height.

16. The apparatus defined in claim 9 wherein one of the orbital shafts is positioned at a first distance from a front end of said housing and another of the orbital shafts is positioned at a second distance from said front end of said housing.

* * * * *